US010132020B2

(12) United States Patent
Muenstermann

(10) Patent No.: US 10,132,020 B2
(45) Date of Patent: Nov. 20, 2018

(54) APPARATUS FOR THE THERMAL TREATMENT OF A TEXTILE WEB

(71) Applicant: TRUETZSCHLER GMBH & CO. KG, Moenchengladbach (DE)

(72) Inventor: Ullrich Muenstermann, Egelsbach (DE)

(73) Assignee: TRUETZSCHLER GMBH & CO. KG, Moenchengladbach (DE)

( * ) Notice: Subject to any disclaimer, the term of this patent is extended or adjusted under 35 U.S.C. 154(b) by 55 days.

(21) Appl. No.: 15/331,986

(22) Filed: Oct. 24, 2016

(65) Prior Publication Data

US 2017/0114486 A1 Apr. 27, 2017

(30) Foreign Application Priority Data

Oct. 23, 2015 (DE) ..... 10 2015 118 157

(51) Int. Cl.
*D06C 7/00* (2006.01)
*D06B 23/02* (2006.01)
*F26B 13/16* (2006.01)

(52) U.S. Cl.
CPC ..... *D06C 7/00* (2013.01); *D06B 23/025* (2013.01); *F26B 13/16* (2013.01)

(58) Field of Classification Search
CPC . D06C 7/00; D06C 7/02; D06C 15/08; D06C 2700/21; D06C 2700/10; F26B 13/16; F26B 13/18; F26B 13/10; F26B 13/14; F26B 25/20; D06B 23/025; D06B 23/026; D06B 2700/35; D06B 1/14; D06B 3/10; D06B 3/20; D06B 3/203; D06B 23/02; Y10T 29/49547; Y10T 29/49549; D21F 5/021; D21F 5/02; D21F 5/022
USPC ..... 492/38, 28, 40, 45, 46, 48, 49, 50; 28/104, 105, 106, 167, 165
See application file for complete search history.

(56) References Cited

U.S. PATENT DOCUMENTS 2,284,270 A * 5/1942 Eberts ..... A23B 7/0408 209/238
2,556,153 A * 6/1951 Collins ..... D06F 35/00 312/228
2,701,957 A 2/1955 Newcomb et al.
(Continued)

FOREIGN PATENT DOCUMENTS

DE 10 2011 113 835 A1 3/2013
DE 20 2013 102 203 U1 6/2013
DE 10 2014 102 119 A1 8/2015

OTHER PUBLICATIONS

EP Search Report, dated Apr. 18, 2017, for related EP Application No. 16187369.0, and English translation thereof.

*Primary Examiner* — Amy Vanatta
(74) *Attorney, Agent, or Firm* — Fishbroyles, LLP; Robert Kinberg

(57) ABSTRACT

An apparatus for a thermal treatment of a textile web includes at least one drum with a perforated casing surface around which a material web can be at least partially wrapped, at least one connecting element, and a patterning shell with a plurality of openings separated by ridges fitted onto the casing of the drum. The patterning shell includes at least two segments detachably connected with aid of the at least one connecting element. The at least one connecting element is arranged on or integrated into a ridge.

12 Claims, 7 Drawing Sheets

(56) References Cited

U.S. PATENT DOCUMENTS

| | | | | |
|---|---|---|---|---|
| 3,180,007 | A * | 4/1965 | Gartz | B23K 20/04 492/38 |
| 3,612,627 | A * | 10/1971 | Fuller | E21B 17/105 175/325.6 |
| 3,741,252 | A * | 6/1973 | Williams | E21B 17/105 138/110 |
| 4,031,600 | A * | 6/1977 | Whigham | B26D 7/20 492/48 |
| 4,868,958 | A * | 9/1989 | Suzuki | D04H 18/04 28/104 |
| 5,674,591 | A * | 10/1997 | James | D04H 1/495 428/156 |
| 7,310,859 | B2 * | 12/2007 | Fleissner | C25D 7/04 28/104 |
| 2005/0015950 | A1 * | 1/2005 | Fleissner | D04H 1/46 28/167 |
| 2007/0084580 | A1 * | 4/2007 | Kahl | D21F 3/105 162/368 |
| 2008/0066275 | A1 * | 3/2008 | Munstermann | D04H 18/04 28/104 |
| 2013/0079206 | A1 * | 3/2013 | Farrell | B31F 1/30 492/48 |
| 2014/0215848 | A1 | 8/2014 | Boehn | |
| 2015/0191858 | A1 | 7/2015 | Muenstermann et al. | |

* cited by examiner

APPARATUS FOR THE THERMAL TREATMENT OF A TEXTILE WEB

CROSS-REFERENCE TO RELATED APPLICATION

Priority is claimed herein to German Application No. DE 10 2015 118 157.6, filed on Oct. 23, 2015, the disclosure of which is incorporated herein by reference in its entirety.

BACKGROUND

The present invention relates to an apparatus for the thermal treatment of a textile web. Such an apparatus includes at least one drum or cylinder with a perforated outer casing surface, around which a material web is at least partially wound, wherein a patterning or structured shell with a multitude of openings separated by ridges can be fitted onto the outer casing of the drum.

Methods for the thermal treatment of a textile web of fibrous material or nonwoven include the drying and/or hardening with hot air in a rapid-packager drier, also referred to as a flow-through hot-air drier, in which a heated gas, for example air, flows through the material web, thereby resulting in a drying or hardening. Driers or thermobonders, which comprise one or several drums arranged inside a housing, are known for the drying and hardening of textile webs. A textile web, supplied via an opening in the drying chamber to the drier, wraps itself around a large portion of the drum circumference and is guided around the following drum and/or exits the drying chamber once more. While wrapped around the drum, the material web is subjected to treatment. The treatment may comprise blowing in fresh air that flows through the web and the drum, thereby absorbing moisture from the material web. The material treatment may also include a thermal bonding of the material web as a result of the hot air and/or gas flowing in which can at least partially melt the fibers, which can consist of polyamide, into each other. Additionally, the material web may treated with hot steam.

A smooth, non-structured fibrous material or nonwoven is generally created in the process which can be used, for example, as topsheets for slip inserts. For a change in the product type that requires a structuring of the fibrous material, the patterning shell on the drum must be replaced. The depth of the patterning in the fibrous material depends on the thickness of the casing surface for the patterning shell. However, replacing the patterning shells is very involved since the complete patterning shell must be removed along the longitudinal axis of the drum. Depending on the working width, the patterning shell can have a diameter of up to 4 m and a length of up to 4.5 m. This process is very time-consuming and requires a lot of personnel. Further, the thermobonder is not available for a longer period because of the retooling measures which may include removal of parts of the housing.

SUMMARY OF THE INVENTION

An object of the invention is a modification of an apparatus for the thermal treatment of a textile web, wherein the apparatus includes at least one drum with a perforated casing surface, and wherein a material web can wrap itself at least partially around the casing surface. The goal is to provide an easier replacement of the patterning shell within the shortest time possible.

This object is solved starting with an apparatus for the thermal treatment of a textile web as defined in the preamble to claims 1 and 11, with the respectively characterizing features.

The invention as disclosed in claim 1 includes the technical teaching that a patterning shell consists of at least two segments which can be connected detachably with the aid of at least one connecting element, wherein the at least one connecting element can be arranged on and/or integrated into at least one ridge. A full-surface connection of the individual segments is thus created, which extends over the complete surface of the patterning shell. Owing to the fact that the at least one connecting element can be arranged on or integrated into a ridge, no irregularities result in the pattern-producing surface. According to the prior art, the segments were connected via circulating belts or tightening belts that were either arranged only outside of the working width of the patterning shell, causing the segments not to rest flat on the drum, or which left an impression in the pattern that had to be used later on as a separation location. As a result, the material web could not be processed over the complete working width.

According to one advantageous embodiment, the connection between two segments can be embodied hinged or pivoting. As a result, at least two segments can be inserted pre-assembled and folded into the drier housing, thereby reducing the stopping times and facilitating the assembly.

The connecting element is advantageously embodied as a pin or shaft that joins two side-by-side arranged segments. The pin functions as a pivoting point and can be pulled out along one open end of the drum. Since the pin is embodied as a thin wire, it can be inserted slightly wound and space-saving into the drum housing, even if the patterning shell extends over a long distance.

Each of the side-by-side arranged segments preferably contains at least one bore hole for accommodating the pin which engages in a recess of a ridge in the adjacent segment. Thus, the pin connects side-by-side arranged segments in the manner of a hinge.

According to a different advantageous embodiment, the connecting element is arranged parallel to the longitudinal axis of the drum. This results in the simplest embodiment and the easiest division of the segments, the total number of which can enclose the drum completely without a gap. The openings creating the pattern are normally embodied geometric and symmetric, taking the form of a rectangle, square or circle. Optionally shaped patterns such as a heart shape can alternatively also be created.

According to one advantageous embodiment, the connecting element is arranged at an angle to the longitudinal axis of the drum. Other, preferably non-symmetrical patterns such as a triangle or diamond can thus also be worked as openings into the patterning shell.

A number of segments can advantageously enclose the drum completely, thus making possible an economic production of the patterning shell.

In particular with pattern-producing openings which do not correspond to a regular geometric structure, it is advantageous to arrange a compensating element between two segments since a uniform division of the segments over the circumference of the drum is frequently not possible. Another advantage of having a compensating element is that it allows the use of sheet plates as standard parts which in sum cannot cover the circumference of the drier.

According to a different embodiment, the segments can be provided with mandrels, wherein two adjacent segments can be connected via at least one bracket and the wherein the mandrels cooperate with at least one bracket. This results in an extremely low-cost and simple connection between the segments since the ridges can be more easily adapted to each other with respect to width. The pattern-producing surface of the patterning shell is completely untouched since the at least one bracket (with the mandrels) can be accommodated by a recess in the drum.

An alternative solution according to claim 11 does not provide for the segments to be connected to each other, but that the patterning shell consists of at least two segments which can be connected detachably via at least one connecting element to the drum, wherein the at least one connecting element is arranged on or integrated into a ridge. A detachable connection of the segments on the drum is thus possible. However, it is advantageous to combine this connection with the connection between the segments to achieve a secure and full-surface fitting of the segments on the drum.

The connecting element is advantageously embodied in the form of at least one mandrel that engages in a depression in the drum, thereby securely attaching the segment to the drum.

An additional type of fastening can be used for both types of embodiment in that the segments of the patterning shell are attached with spring-tension to the front of the drum. This results in a high safety when fitting the segments against the drum and a very uniform pattern on the material web.

According to a further advantageous embodiment, the segments of the patterning shell can be attached with at least one circulating belt. This circulating belt is mounted in the area of the end faces of the patterning drum, so that the pattern-providing surface is not interrupted over the working width.

BRIEF DESCRIPTION OF THE DRAWINGS

Further measures that improve the invention are explained in detail in the following with the aid of the description of an exemplary embodiment of the invention and the accompanying Figures, wherein.

DETAILED DESCRIPTION

Figure 1:
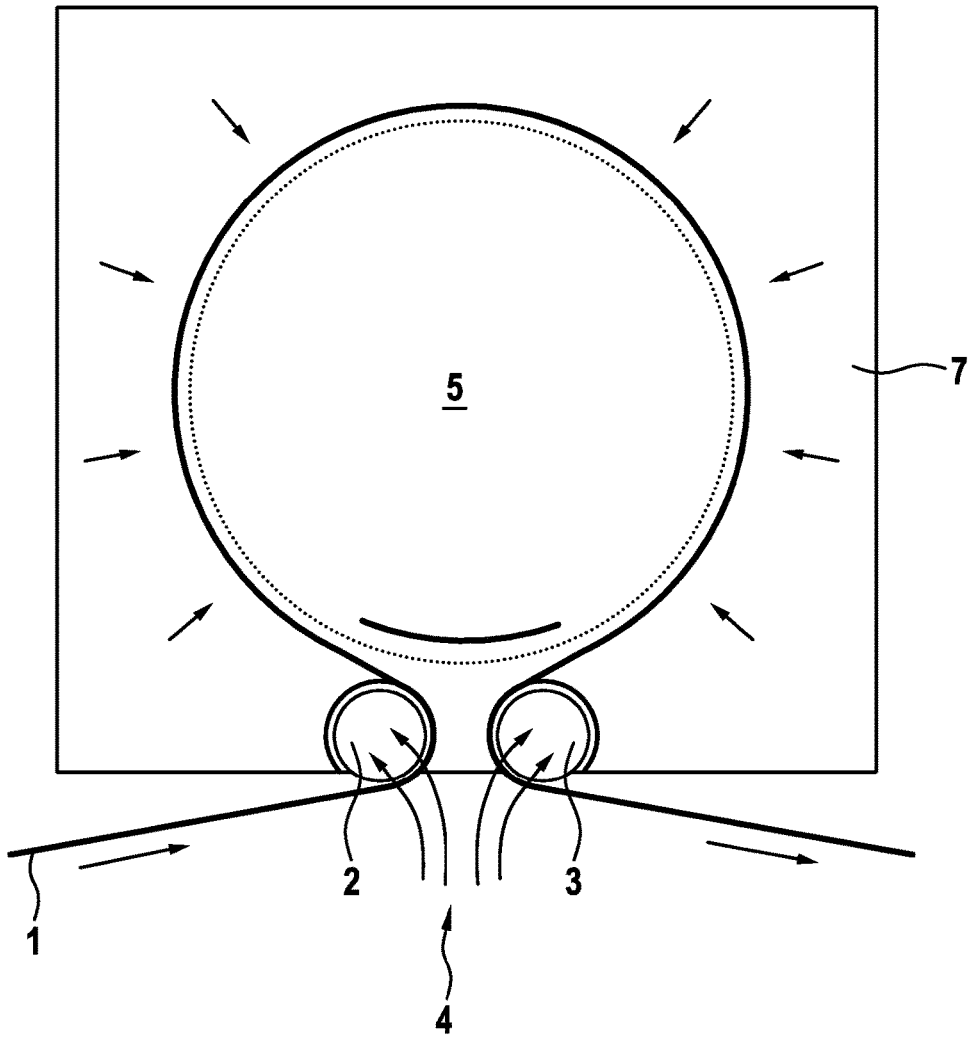
FIG. 1 is a schematic representation, showing a cross-section through a drier or thermobonder.

FIG. 1 shows an Omega-type drier or thermobonder according to the prior art, operated with hot air. The material web 1 to be dried enters the intake area 4 of the drier via a deflection drum 2, wraps itself in clockwise direction around the air-permeable drum 5 and then exits the drier again via a different deflection drum 3. The material web 1 can consist of a bonded web of fibers or filaments. Frequently, the material web 1 consists of a pile warp of loose staple fibers arriving from the carding machine. The pile warp is transported on a conveyor belt from the carding machine to the drum 2. The deflection drum 2 can be embodied as a suction drum designed to transport the loose pile warp to the drum 5 of the drier or thermobonder. The deflection drum 3 can also be embodied as suction drum to cool down the thermally bonded nonwoven or the dried material web with the aid of ambient air. The drum 5, as well as the two deflection drums 2, 3 are arranged inside a housing 7 into which hot air is conducted via means not shown herein. The hot air flows through the material web 1, dries this web or heats up the material web to the melting temperature of the bonding fiber or other bicomponent fibers and is then suctioned off with the aid of a fan arranged in the drum 5 end face, which is not shown herein. In the process, the drum 5 is subjected to a vacuum, so that different flow conditions occur in the drier.

Figure 2:
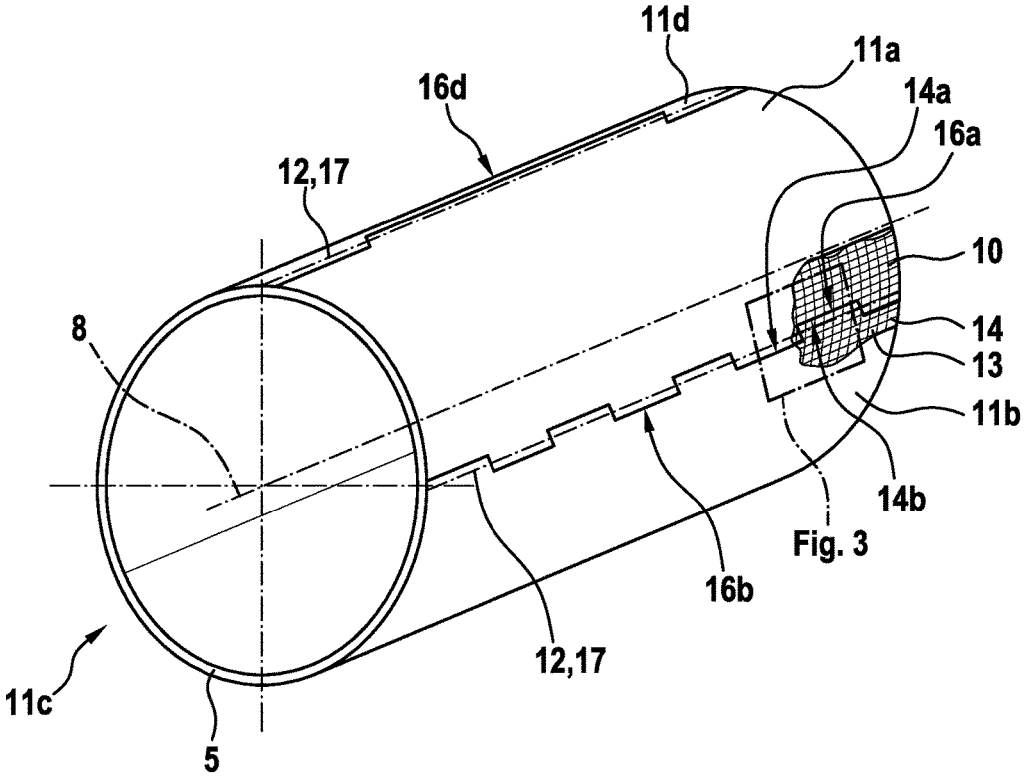
FIG. 2 is a perspective representation of a drum with patterning shell.
Figure 3:
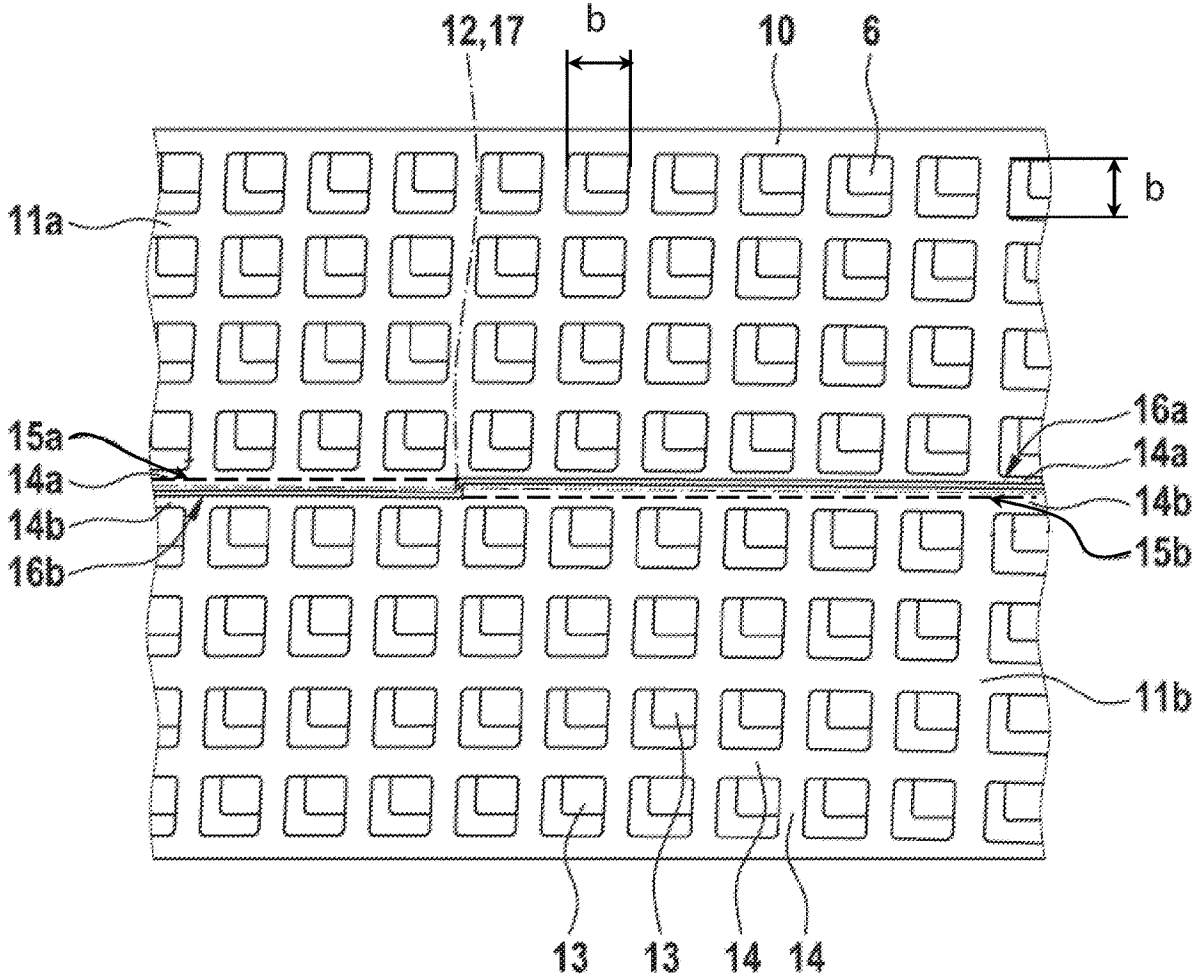
FIG. 3 is an enlarged detail of a patterning shell.

According to an exemplary embodiment illustrated in FIGS. 2 and 3, the drum 5 can be fitted with a screen cloth 6 which consists of wires having a diameter of 0.1 to 0.5 mm. The wire spacing for fine screens is approximately 0.3 mm and for rougher screens can increase to 1.5 mm. This screen cloth 6 is designed to prevent fibers from entering the drum 5 once it is subjected to a vacuum. With a structured thermobond, it is possible to sometimes omit the screen cloth.

The patterning shell 10 according to the invention, which is provided with a plurality of openings 13, respectively having a size or edge length b of 1 to 30 mm, is fitted onto the screen cloth 6 or directly onto the drum 5. The openings 13, which in this case are rectangular or square, are always surrounded on all sides by ridges 14 which delimit the openings 13 and can have a width of 1 to 10 mm. The patterning shell 10 can have a wall thickness of 0.5 to 6 mm, preferably ranging from 1.5 to 4 mm.

FIG. 2 shows a schematic representation of a portion of the patterning shell, shown enlarged in FIG. 3 shows the outside of the patterning shell 10 where the material web is being processed. Instead of the rectangular or square openings 13, the patterning shell can also have diamond-shaped, rectangular, round or optionally formed openings.

Figure 4:
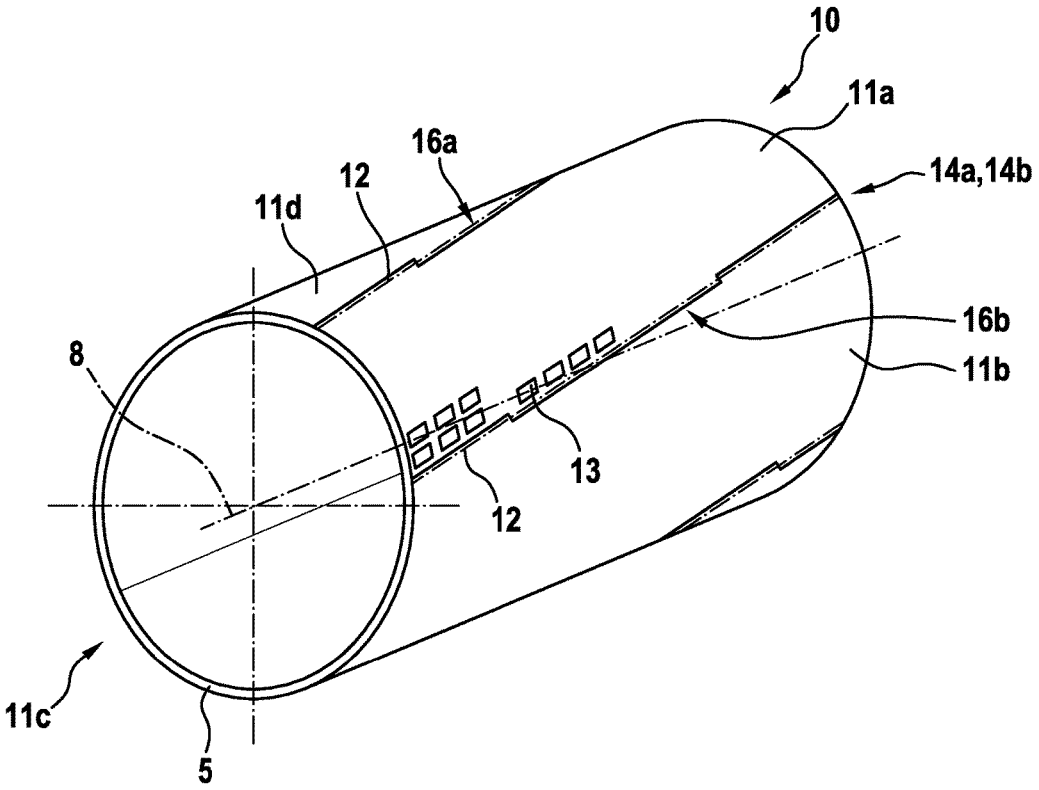
FIG. 4 is a further variant of a divided patterning shell.

According to the invention, the patterning shell 10 for the exemplary embodiment shown in FIGS. 2 to 4 is composed of four individual segments 11*a*, 11*b*, 11*c*, 11*d* which can be joined and arranged around the drum 5. This arrangement has the advantage that each segment 11*a*-11*d* can be transported individually via a mounting opening into the drier or thermobonder, without having to dismantle the housing. Each segment 11*a*-11*d* in this case preferably matches the length of the drum 5. At least 2, preferably 4 to 6, segments of the patterning shell 10 are advantageously fitted onto the circumference of the drum 5.

So that the connected segments 11*a*-11*d* do not leave impressions in the fibrous material, a connecting element 12 can be affixed to or integrated into a ridge 14, thus making the connecting element 12 a part of the patterning shell 10. Alternatively, the connection of the segments 11*a*-11*d* can also be arranged on the underside of the patterning shell 10, meaning facing the drum. The connecting element 12 can thus engage in an opening or recess in the drum 5 to create a uniform and even pattern on the material web.

According to one embodiment, the segments 11*a*-11*d* of the patterning shell 10 are connected detachably. In the embodiment shown in FIGS. 2 and 3, an upper first segment 11*a* shows a ridge 14*a* that is delimited toward the outside (downward). A lower second segment 11*b* also shows a ridge 14*b* that is delimited toward the outside (upward). Both ridges 14*a*, 14*b* are arranged relative to each other so as to correspond to the total width of a "normal" ridge width and such that the pattern does not become irregular at this connecting location.

On the left half of the representation showing the ridge 14*b*, the lower segment 11*b* is provided for this with a recess 16*b* in which a section of the ridge 14*a* can engage. This section of the ridge 14*a* contains a bore hole 15*a*.

On the right side of the representation, the ridge 14*a* of the upper segment 11*a* contains a recess 16*a* in which a portion of the ridge 14*b* can engage. This portion of the ridge 14*b* also contains a bore hole 15*b*. The bore holes 15*a*, 15*b* can be fitted in a longitudinal direction through the ridge 14, depending on the length, or can be connected to the ridges through soldering, welding or press-fitting.

A connecting element 12, in the shape of a pivot 17 that connects the segments 11*a*, 11*b* along the longitudinal axis 8 of the drum 5, is fitted into the bores holes 15*a* and 15*b*. The connection via pivot 17 is detachable since the pivot 17 is embodied such that it can be pulled out at one end of the patterning shell 10.

According to this exemplary embodiment, the connection via the pivot 17 furthermore functions as a hinge, thus making it possible to insert respectively two segments 11*a*, 11*b* or several segments that are pre-assembled and folded through the mounting opening into the drier where the final assembly can take place together with the other segments 11*c*, 11*d*.

According to FIG. 2, the connection between the segment 11*a* and the segment 11*b* contains several recesses 16*a*, 16*b* which alternately form an overlapping region along the length of the drum 5, wherein this region is penetrated by the connecting element 12 in the form of a pivot 17. The connection between the segment 11*a* and the segment 11*d* only has a single recesses 16*d* in which a ridge of the segment 11*a* engages.

The invention has the advantage of an easier assembly of the patterning shell 10, which thus consists of individual segments 11*a*-11*d*, but that the connecting locations for the segments 11*a*-11*d* are not visible in the generated fibrous material. According to the invention, the connection 12 between the individual segments 11*a*-11*d* is embodied as a detachable connection 12 that is furthermore hinged for the present example.

The bore holes 15*a*, 15*b* taking the form of a thin tube are mounted on or integrated into the ridges 14*a*, 14*b*, for example by welding, soldering or pressing on, wherein the tube can have a round, oval, square or polygonal cross section. According to the embodiments shown in FIGS. 2 and 3, the bore holes 15*a*, 15*b* are arranged along the longitudinal side of the segments 11*a*, 11*b* and precisely parallel to the longitudinal axis 8 of the drum 5.

The pivot 17 can be embodied as a thin wire, for example 0.3 to 2 mm thick, which connects the hinge halves in a similar manner as a strap hinge.

Of course, multiple recesses 16*a*, 16*b* can also be arranged alternating along the outer delimitation of the segments 11*a*, 11*b*, so that the pivot 17 penetrates the segments 11*a* and 11*b* alternating at multiple locations.

In contrast to FIGS. 2 and 3, FIG. 4 shows a pattern on the patterning shell 10 for which the individual segments 11*a*-11*b* do not orient themselves on the longitudinal axis 8 of the drum 5 but are arranged at an angle thereto. The openings 13, which are shown herein noticeably enlarged from the actual size, can be embodied diamond-shaped or triangular and can thus orient themselves along a ridge 14 that is arranged at an angle to the longitudinal axis 8 of the drum 5, wherein the connection is arranged detachably as shown in FIGS. 2 and 3. Respectively one bore hole 15*a*, 15*b* in this case as well is arranged on or fitted into each ridge 14, with a pivot 17 engaging therein and thus forming a connection between the segments 11*a*-11*d*. The angled arrangement of the pivot 17, relative to the longitudinal axis 8 of the drum 5, results in a curvature of the pivot 17 which can thus function only to a limited degree as a hinge, with additional bending stress on the pivot 17 and the bore holes 15*a*, 15*b*.

Figure 5:
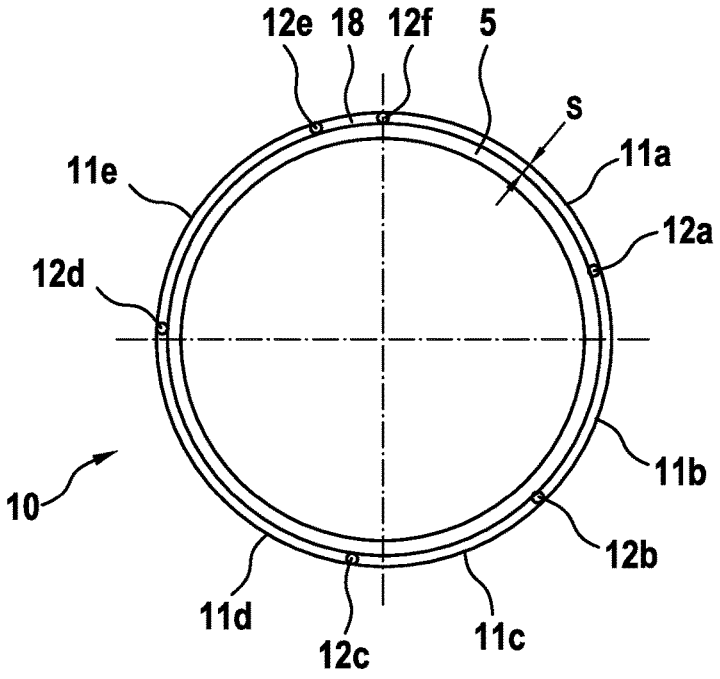
FIG. 5 is a further embodiment of a divided patterning shell.

For the exemplary embodiment according to FIG. 5, a patterning shell 10 consisting of five segments 11*a*-11*e* and a compensating element 18 is mounted on the drum. The segments 11*a*-11*e* are produced, for example, from perforated plates which are obtained cheaply as standard parts, to be sure, but can be supplied only for a defined width. Since an undetermined width of the patterning shell 10 must frequently be enclosed, the compensating element 18 is provided which is adapted precisely to the alignment of the openings (square and rectangle, triangle, diamond, circle) with the aid of a laser cutter, such that it can be inserted precisely into the non-covered gap along the drum circumference. As a result, pattern openings such as stars or figures can also be used in addition to the geometric openings. For the present example, the segments 11*a*-11*e* are again connected with connecting elements 12*a*-12*d* which, in the form of soldered-on tubes or inserted bores 15, respectively operate jointly with a pivot 17 to create a hinged connection for the segments 11*a*-11*e*. The same principle is used for the connection between the segments 11*e* and 11*a* and the compensating element 18. Here too, the patterning shell 10 is fitted around the drum 5 and closed via a detachable and, if applicable, hinged connection.

Figure 6:
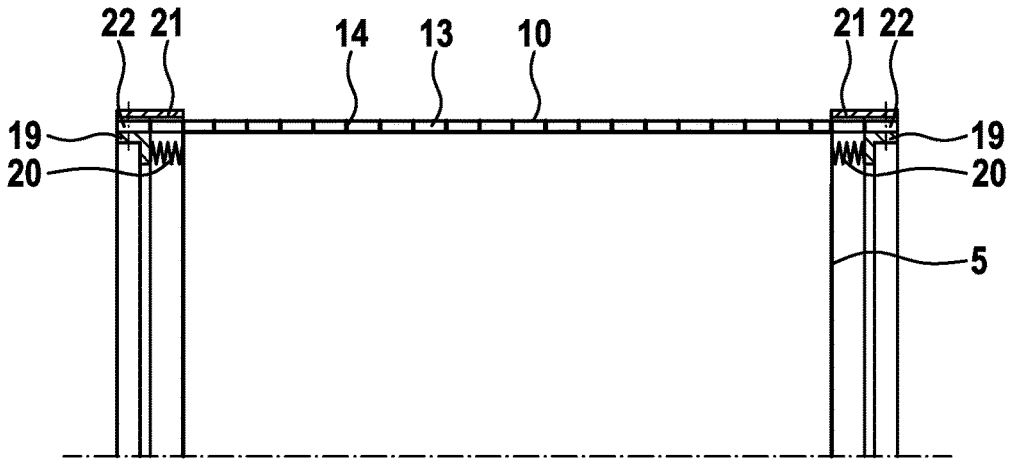
FIG. 6 is a sectional view through the drum with patterning shell.

FIG. 6 shows the fastening of the patterning shell 10 on a drum 5 in the end region of the drum 5. The openings 13 and the ridges 14 are shown enlarged for a better view. The patterning shell 10 extends lengthwise on both sides over the length of the drum 5 and is additionally tensioned and attached thereon. With the aid of a circulating angle bracket 19 on each end face of the drum 5, the patterning shell 10 is attached with these angle brackets 19 and fastening elements 22. Spring elements 20 are arranged between the angle brackets 19 and the drum 5 to ensure a tensioning of the patterning shell 10. The fastening elements 22 are arranged fixedly on one side of the drum 5 with the aid of the angle brackets 19 and are attached flexibly on the opposite side, along the longitudinal axis 8 of the drum, so that thermal stresses can also be compensated by the spring elements 20. The lengthwise tensioning of the pattern-providing drum 10 additionally ensures a flat support surface for the pattern-providing drum 10 with individual segments, thereby resulting in a uniform pattern being applied to the material web. The pattern-providing drum 10 can be attached in the edge region with the aid of a circulating belt 21.

Figure 7:
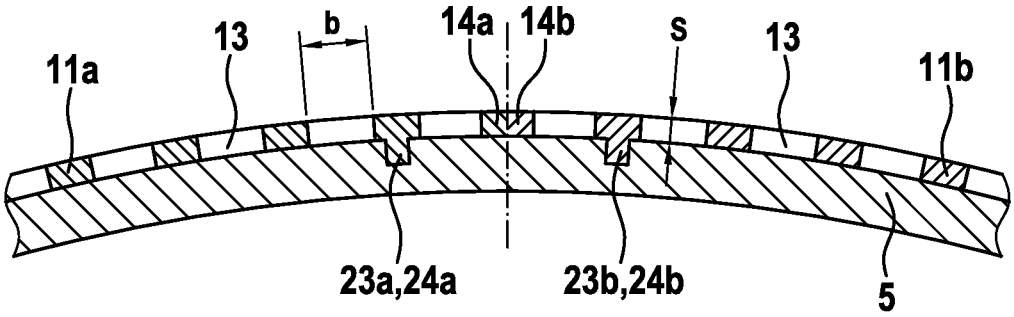
FIG. 7 is a schematic sectional view through the drum with patterning shell.

FIG. 7 schematically shows an alternative fastening option for the segments 11*a*, 11*b* of the patterning shell 10 on the drum 5, shown enlarged without the suction openings. Shown on the left is the segment 11*a* and on the right the segment 11*b*. The openings 13 are surrounded by ridges 14, wherein at the separation location the ridges 14*a* and 14*b* jointly form the normal width of a ridge 14. At the crossing point between the horizontally and vertically arranged ridges (see FIG. 3) respectively one mandrel 23*a*, 23*b* is arranged along a row of ridges, over the complete length of the segments 11*a*, 11*b* and evenly spaced, where the mandrel engages in a corresponding depression 24 in the drum. The segments 11*a*-11*e* are tensioned in the region of the end face of the drum 5 with the aid of the belt 21 shown in FIG. 6.

The mandrels 23*a*, 23*b* can preferably be welded or soldered onto the crossing points. The pins can not only be arranged in the region of the longitudinal edges of the segments 11*a*, 11*b*, but can also be distributed over the complete surface of the segments 11*a*, 11*b*, wherein the corresponding depressions 24 must then also be worked into the drum 5. In any case, the arrangement of the mandrels also depends on the arrangement of the suction openings in the drum 5. This type of fastening can be combined with the previously mentioned fastenings of the segments, thus resulting in a high safety and roundness when fitting on the segments. The resulting pattern on the material web is very uniform since the segments are fastened more securely on the drum over their length and/or the surface by the type of fixation points used.

Alternatively, the mandrels can also form components of the drum 5 and can engage in openings at the crossing points for the ridges, wherein the surface facing the material web must be smooth in that area, so that no irregular pattern appears on the material web.

Figure 8:
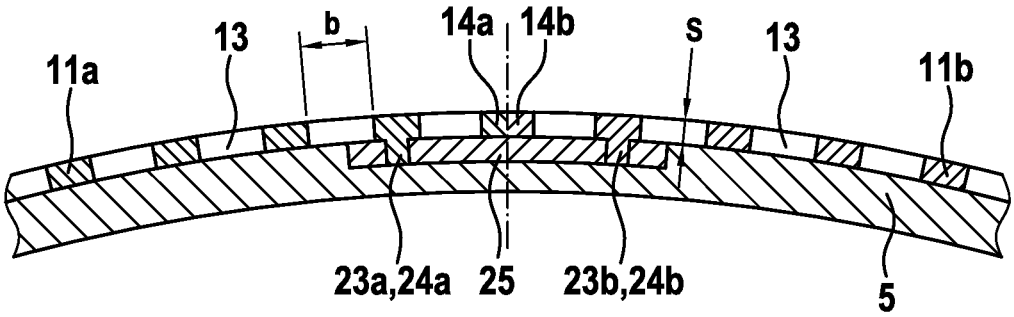
FIG. 8 is another schematic sectional view through the drum with patterning shell.

FIG. 8 also schematically shows an alternative fastening option for the segments 11*a*, 11*b* of the pattern-providing drum 10 on the drum 5, shown herein enlarged and without the suction openings. The segment 11*a* is shown on the left and the segment 11*b* on the right. The openings 13 are surrounded by ridges 14, wherein at the separating location the ridges 14*a* and 14*b* jointly have the width of a single ridge 14. At the location where the horizontal and vertical ridges cross (see FIG. 3), respectively one mandrel 23*a*, 23*b* is arranged at regular intervals in a row of ridges, over the complete length of the segments 11*a*, 11*b*. The mandrels 23*a*, 23*b* are connected via at least one bracket 25, wherein these brackets connect the segments 11*a*, 11*b* at multiple locations along the longitudinal axis. A corresponding depression 24 is arranged within the drum 5 into which the at least one bracket 25 as well as the mandrels 23*a*, 23*b* are submerged. The segments 11*a*-11*e* can be tensioned with the belt 21 shown in FIG. 6 in the end face region of the drum 5. The mandrels 23*a*, 23*b* can preferably be welded or soldered onto the crossing points. The at least one bracket 25 can consist of temperature-resistant plastic or metal, for example copper or sheet plate. When using a plastic material, the connecting element in the form of a bracket can also be embodied detachable and hinged. Even if the bracket 25 is embodied as a thin copper plate, an at least detachable and partially hinged connection is provided. For this, a bracket 25 can also be used for all mandrels of two adjacent segments 11*a*, 11*b*, wherein the bracket 25 in that case extends along the longitudinal edges of the segments 11*a*, 11*b*. Of course, this single bracket 25 can also be provided with openings that correspond to the openings in the drum 5.

Figure 9:
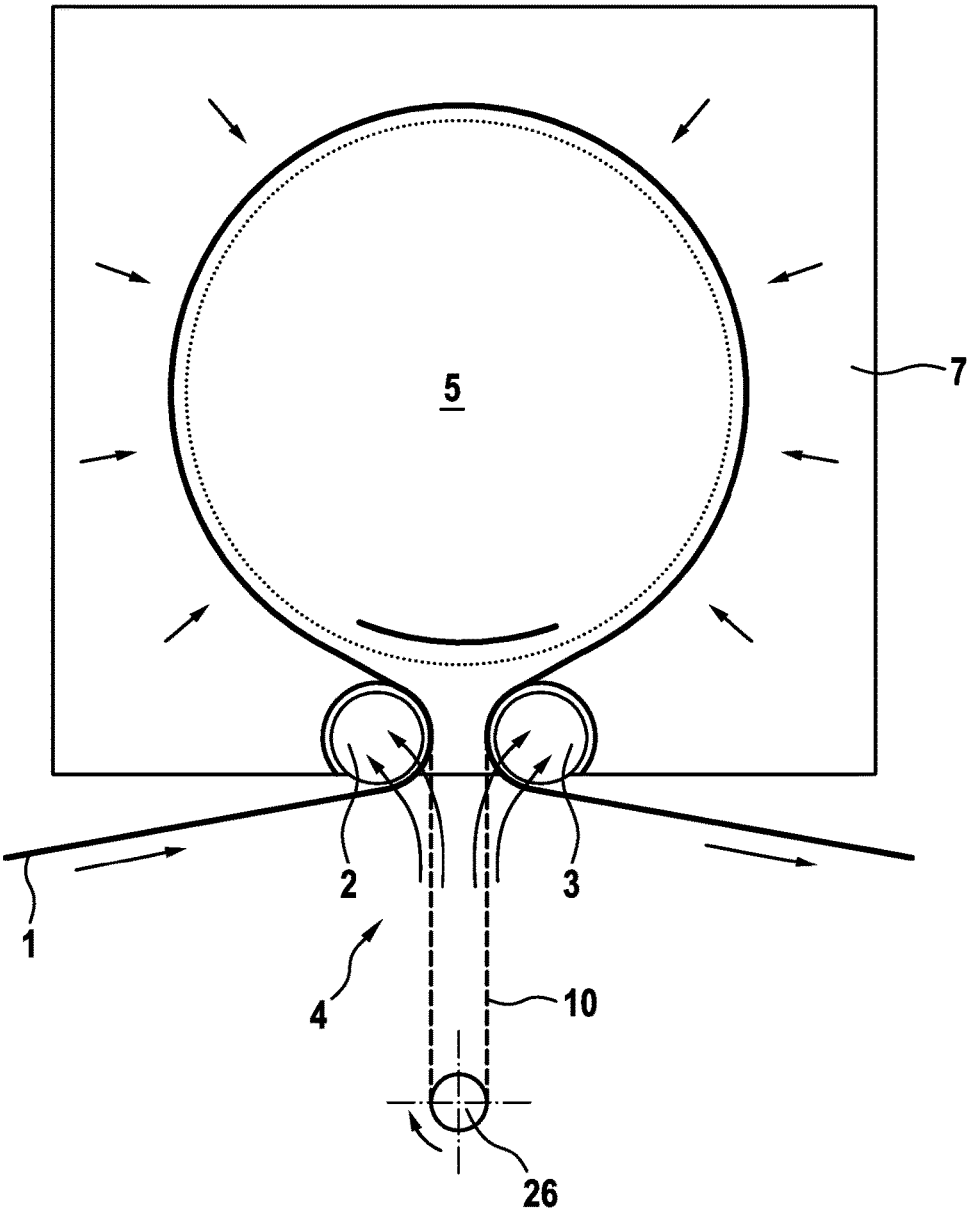
FIG. 9 is another schematic sectional view, showing a cross section through a drier or thermobonder.

According to the exemplary embodiment shown in FIG. 9, the patterning shell 10 is embodied as flexible element which is guided around the drum 5, is then guided out of the housing 7 for the drier or thermobonder and is deflected by a deflection roller 10. This patterning shell is furthermore composed of several parts, meaning individual segments, having a flexible structure. The connections between the individual segments according to this exemplary embodiment are thus always embodied hinged. As a result, the flexible patterning shell shown for this example can in principle also be used for structuring a material web on a belt furnace.

According to the invention, the patterning shell 10 segments are joined seamlessly, so that no irregularities are visible in the pattern on the material web. Connecting elements arranged on or in the ridges are used for the fastening. The term ridge in this case refers in general to the pattern-providing surface of the patterning shell 10 which surrounds an opening, wherein for geometric patterns the ridges also extend geometrically, as a rule horizontally or vertically. The spacing (=ridge) between two pattern-providing openings is generally smaller than the clear width and/or the diameter of the pattern-providing opening.

The patterning shell 10 sections arranged in the end regions of the drum 5 can additionally be tensioned, meaning outside of the working width of the drum 5, so that the tensioning means do not leave impressions on the material web. The patterning shell 10 can consist of a metal material or a heat-resistant plastic material, wherein the segments can be embodied rigid or flexible.

The invention makes use of the finding that a fibrous material or nonwoven can be structured simultaneously with the drying or bonding, wherein as a result of the flat structuring the material web has a better appearance while, at the same time, a volume increase can be achieved. During an experiment, a fibrous material was processed which consisted to 100% of bicomponent fibers having a 30 g/m$^2$ weight. A processing of the fibrous material without patterning shell resulted in a thickness of 0.64 mm. When using the patterning shell, a thickness of 1.3 mm resulted with nearly the same firmness of texture.

The invention can be used for a drier or thermobonder having a single drum, as well as a drier or thermobonder with several flow-through drums around which the material web wraps itself successively at least in part.

It will be understood that the above description of the present invention is susceptible to various modifications, changes and adaptations, and that the same are intended to be comprehended within the meaning and range of equivalents of the appended claims.

REFERENCE NUMBERS

1 material web
2 deflection drum
3 deflection drum
4 intake region
5 drum
6 screen fabric
7 housing
8 longitudinal axis
10 patterning shell
11*a*-11*e* segment
12*a*-12*f* connecting element
13 opening
14, 14*a*, 14*b* ridge
15*a*, 15*b* bore hole
16*a*, 16*b*, 16*d* recess
17 pivoting pin
18 compensating element
19 angle bracket
20 spring element
21 belt
22 fastening element
23*a*, 23*b* mandrel
24 depression
25 bracket
26 deflection roller
b size and/or edge length
s wall thickness

The invention claimed is:

1. An apparatus for a thermal treatment of a textile web, comprising:

at least one drum with a perforated casing surface around which a material web can be at least partially wrapped;

at least one connecting element; and a patterning shell with a plurality of openings separated by ridges fitted onto the casing of the drum, wherein the patterning shell includes at least two segments detachably connected with aid of the at least one connecting element, and wherein the at least one connecting element is arranged on or integrated into one of the ridges.

2. The apparatus according to claim 1, further including a connecting element comprising a hinge or rotary joint to connect between the at least two segments.

3. The apparatus according to claim 1, wherein the connecting element comprises a pivot that connects two side-by-side arranged segments.

4. The apparatus according to claim 3, wherein each of the side-by-side arranged segments includes at least one bore hole to accommodate the pivot which engages in a recess in a ridge of the adjacent segment.

5. The apparatus according to claim 1, wherein the connecting element is arranged parallel to a longitudinal axis of the drum.

6. The apparatus according to claim 2, wherein the connecting element is arranged at an angle to a longitudinal axis of the drum.

7. The apparatus according to claim 1, wherein the drum is completely enclosed by a number of segments.

8. The apparatus according to claim 1, further comprising a compensating element arranged between the at least two segments.

9. The apparatus according to claim 1, further including mandrels and brackets, wherein two adjacent segments are joined with the aid of at least one bracket, and wherein the mandrels operate jointly with the at least one bracket to join the segments.

10. The apparatus according to claim 9, wherein the at least one bracket is accommodated in a depression of the drum.

11. The apparatus according to 1, wherein the segments of the patterning shell are spring-tensioned and are attached to at least one end face of the drum.

12. The apparatus according to claim 11, wherein the segments of the patterning shell are fastened with the aid of at least one circulating belt.

* * * * *